US005191729A

United States Patent [19]

Verseef

[11] Patent Number: 5,191,729

[45] Date of Patent: Mar. 9, 1993

[54] TRIP APPARATUS FOR MOLDBOARD ASSEMBLY

[75] Inventor: Jan H. Verseef, Clayton, N.Y.

[73] Assignee: Frink America, Inc., Clayton, N.Y.

[21] Appl. No.: 767,477

[22] Filed: Sep. 30, 1991

[51] Int. Cl.[5] ..... E01H 5/04

[52] U.S. Cl. ..... 37/232; 37/235; 37/270

[58] Field of Search ..... 37/233, 232, 235, 266, 37/270, 271, 279

[56] References Cited

U.S. PATENT DOCUMENTS

| | | | |
|---|---|---|---|
| 3,014,289 | 1/1959 | Torrey . | |
| 4,255,878 | 3/1981 | Mähler | 37/232 |
| 4,307,523 | 12/1981 | Reissinger et al. | 37/232 X |

FOREIGN PATENT DOCUMENTS

| | | | |
|---|---|---|---|
| 168983 | 9/1951 | Austria | 37/232 |
| 823224 | 12/1951 | Fed. Rep. of Germany | 37/232 |
| 74552 | 5/1954 | Netherlands | 37/232 |

*Primary Examiner*—Randolph A. Reese
*Assistant Examiner*—J. Russell McBee
*Attorney, Agent, or Firm*—Wall and Roehrig

[57] ABSTRACT

Safety apparatus for use in a moldboard assembly having a plurality of horizontally aligned trip blade units pivotally supported in the bottom of the moldboard frame so that the units move independently between a downwardly extended operative position and a rearwardly extended, fully tripped position. A biasing mechanism urges each unit into the operative position with a predetermined amount of force. A control mechanism further regulates the biasing force exerted on each unit so that the biasing force first increases as the unit moves out of the operative position and then decreases as the unit continues to move into the fully tripped position. The force exerted on each unit when in the fully tripped position is considerably less than that used to hold the unit in the operative position thereby preventing the assembly from lifting as it moves over an obstacle.

19 Claims, 2 Drawing Sheets

TRIP APPARATUS FOR MOLDBOARD ASSEMBLY

BACKGROUND OF THE INVENTION

This invention relates to a biased trip blade apparatus for use in a moldboard assembly and, in particular, to a mechanism for controlling the biasing force acting upon the unit as it moves over an obstacle to prevent the assembly from being damaged.

Many heavy duty snow plows used to clear highways, and some smaller plows used to clear driveways and the like, are presently equipped with trip edge blades. The trip edge blade is typically hinged for rotation beneath the moldboard and is held securely in a down or operative position by means of heavy duty compression springs. The springs are held in a stationary position and are arranged to compress along the axis of the coil as the trip blade is forced back by an obstacle from the operative position toward a fully tripped, open position.

Most trip blade units presently in use cannot effectively pass over obstacles of any substantial height. Typically, the springs will become fully compressed before the blade has cleared the obstacle. As a consequence, the moldboard assembly is lifted by the obstacle. When this occurs, serious damage to both the moldboard assembly and the prime mover to which it is attached can ensue.

Torrey in U.S. Pat. No. 3,014,289 discloses a spring regulated trip blade unit wherein the trip blade is connected to a spring mechanism through means of a lost motion device. The lost motion device permits the trip blade to move back out of its operative or snow plowing position some distance before the spring is actually engaged. Although this helps to protect the blade unit from being damaged upon its striking a relatively low obstacle, it also allows the blade to swing back some distance when plowing heavy or deep snow. This results in incomplete plowing and requires multiple passes to complete the snow clearing operation.

Many curbs bordering roadways, particularly on military bases and the like, are raised to heights of ten inches or more and can be easily struck by the curb side edge of a plow. In light of the fact most trip blades extend across the entire face of the plow, this type of impact will not only tend to lift the moldboard assembly but will also produce an extremely high torque loading on the assembly.

SUMMARY OF THE INVENTION

It is therefore an object of the present invention to improve snowplowing equipment.

Another object of the present invention is to improve trip blade units used in snowplowing equipment.

Yet another object of the present invention is to provide a trip blade unit that is capable of passing over relatively high obstacles without causing damage to the plow or the prime mover used to propel the plow.

A further object of the present invention is to provide a trip blade unit having a control mechanism for regulating the biasing force acting on the blade which enables the blade to pass over relatively high obstacles without lifting the plow.

A still further object of the present invention is to reduce the amount of torque experienced by a snowplow when striking an off center obstacle.

These and other objects of the present invention are attained by a trip blade apparatus for use in a moldboard assembly in which a plurality of relatively short length trip blade units are hinged continuously along the moldboard frame beneath the moldboard so that each trip blade is able to swing independently between an operative position and a fully tripped position. Each trip blade is connected to a pair of compression spring assemblies by means of a control mechanism that functions to regulate the spring force acting on the blade unit as it moves from an Operative snow plowing position to a fully tripped position. The spring force acting on the blade unit when it is in the fully tripped position is less than that acting on the blade unit when it is in the operative position.

BRIEF DESCRIPTION OF THE DRAWINGS

For a better understanding of these and other objects of the present invention reference will be made herein to the following detailed description of the invention which is to be read in association with the accompanying drawings, wherein.

DESCRIPTION OF THE INVENTION

Figure 1:
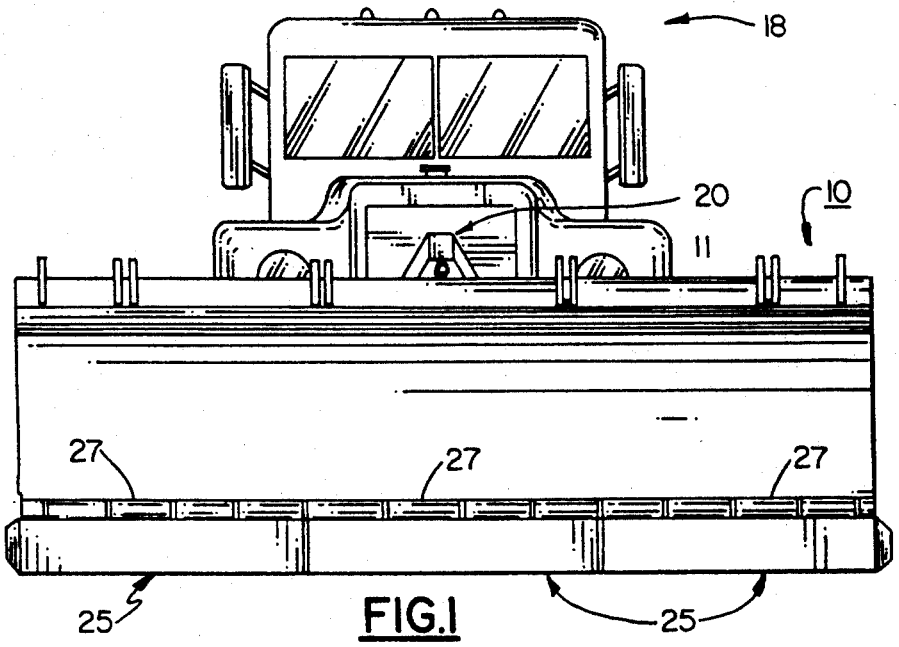
FIG. 1 is a front view of a moldboard assembly embodying the teachings of the present invention shown mounted upon the front of a prime mover (truck)
Figure 3:
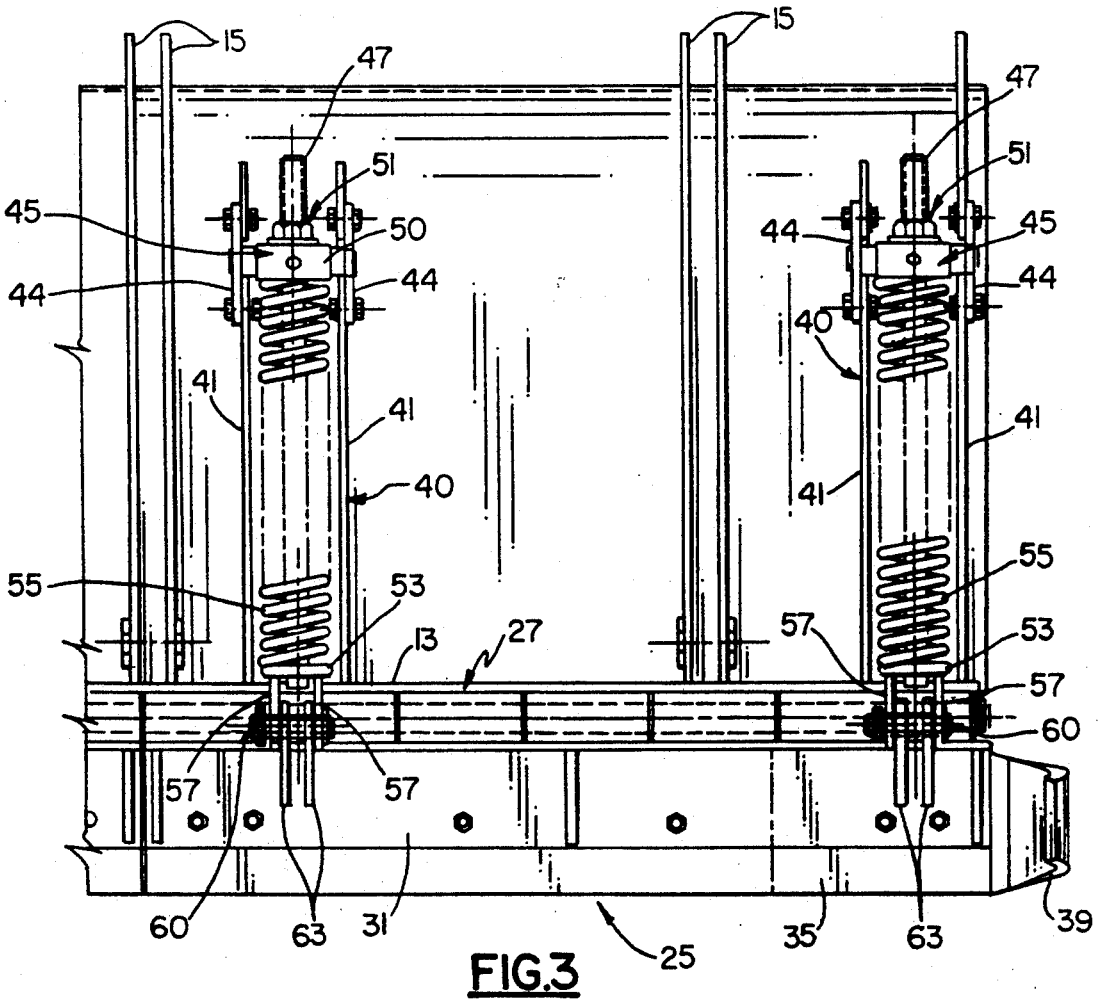
FIG. 3 is a partial rear view of the moldboard assembly illustrated in FIG. 2.

Referring now to FIGS. 1-4, there is shown a moldboard assembly generally referenced 10 that utilizes a trip blade unit embodying the teachings of the present invention. The assembly includes a frame 12 that includes a lower horizontal support member 13 that is connected to a parallel upper support member 14 by a series of vertically disposed contoured ribs 15—15. A moldboard 17 formed of flexible material is seated against the contoured front surfaces of the ribs between the upper and lower support members and is held in place by suitable welds, rivets or the like. In assembly, the face of the moldboard forms a volute that is arranged to control the flow of snow as it moves thereover. The moldboard frame is connected to the chassis of the prime mover, which in this case is a truck 18, by means of a suitable hitch 20. The moldboard assembly is remotely positioned from the cab of the truck by hydraulic cylinders (not shown) to direct snow to one side or the other of the truck.

A plurality of trip blade units 25—25 are suspended in a side-by-side contiguous relation beneath the moldboard by means of horizontally disposed hinges 27—27 secured to the lower support member 13. In the present embodiment of the invention, three individual trip blades are pivotally mounted in the support member beneath the moldboard although it should become evident from the description below that the number of trip blade units employed may vary in regard to the length of the moldboard. Preferably, each blade should extend a relatively short distance across the face -f the moldboard to minimize the amount of torque experienced by each blade when it comes in contact with an obstacle. It has been found that a trip blade length of approximately four feet will hold the torque to an acceptable level under most operating conditions. It should be further noted that because of the unique spring control mechanism employed in the present unit, the trip blade is able to pass over obstacles six inches without producing a lifting effect on the moldboard assembly or the prime mover.

Figures 2, 4:
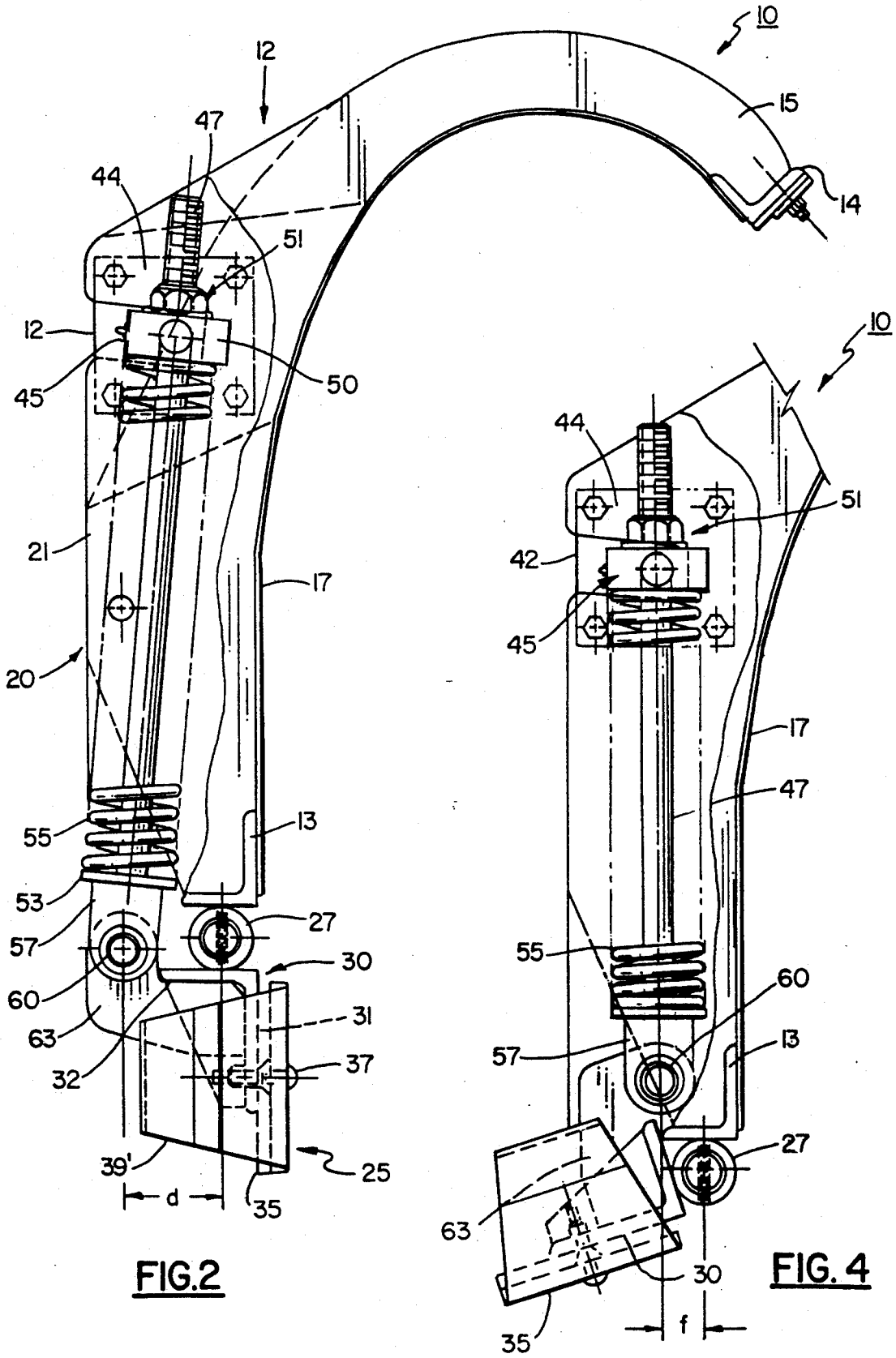
FIG. 2 is an enlarged side elevation showing the trip blade unit in an operative position section of the moldboard assembly illustrated in FIG. 1.
FIG. 4 is a partial side elevation showing the trip blade unit of the present invention rotated back into the fully opened or tripped position.

As best seen in FIGS. 2 and 4, each trip blade unit 25 includes a horizontally disposed support angle 30 having a vertical leg 31 and a horizontal leg 32. The horizontal leg is secured to hinge 27, as for example by welding. A downwardly extended front plate 35 is secured to the front face of the vertical leg by means of bolts 37. The front plate extends downwardly some distance beyond the lower edge of the vertical leg and in practice provides the scraping action for the moldboard assembly.

Each of the two outboard trip blade units is furnished with a curved bumper 39 that is also bolted to the support angle using bolts 37. The bumpers protrude beyond the outer edges of the trip blade units and are turned back about ninety degrees from the front face of the moldboard to protect the units from foreign objects.

Positioned adjacent to the opposed side edges of each trip blade is a vertically disposed spring assembly, generally referenced 40. Each spring assembly includes a pair of vertical side brackets 41—41 that are securely welded to the back of the moldboard in a spaced apart parallel relationship. Each bracket contains a horizontal cut-out 42 located near the top edge thereof. Bearing blocks 44—44 are bolted to the outside of the brackets over the cut-outs. A trunnion 45 is rotatably supported between the bearing blocks in a manner that permits the trunnion to swing freely about a horizontal axis inside the two brackets.

An elongated threaded rod 47 is passed through a suitable clearance hole formed centrally in the trunnion body 50. A nut and washer assembly 51 are carried on the upper end of the rod and is arranged to bear upon the top surface of the trunnion body. A base plate 53 is welded to the bottom section of the elongated rod and a compression spring 55 is wound about the rod so that it is compressed between the base plate and the bottom surface of the trunnion. By tightening or loosening the bolt unit, the spring can be pre-loaded to a desired level.

A pair of parallel spaced apart tabs 57—57 are welded to the bottom surface of the base plate and a horizontally disposed pivot pin 60 is suspended between the tabs. A pair of parallel links 63—63 of similar construction are also pivotally suspended from the pivot pin. The links are contoured to pass under the vertical leg 32 of the trip blade support angle 30 and are welded to the inside of both the vertical and horizontal leg thus connecting the spring assembly to the trip blade unit. In assembly, the axis of the hinge 27 is separated from the axis of pin 60 by a distance d (FIG. 2).

In assembly, the pivot pin 60 of each spring assembly is placed slightly below the horizontal axis of the hinge 27 when the trip blade is in the operative or plowing position as shown in FIG. 2. As can be seen, the springs are free to swing with the trunnions while at the same time exerting a downward force on the links which serve to hold the trip blade unit in the operative position shown in FIGS. 2 and 3 with a pre-determined force.

In the event one of the trip blade units strikes an obstacle as it is being propelled forwardly, the combined holding forces exerted by the springs will be overcome and the trip blade unit will turn back about the hinge 27 toward the raised or fully tripped position as shown in FIG. 4.

As the trip blade unit begins to turn about the hinge 27, the distance between the trunnions and the base plates shortens and the springs in the two opposed assemblies compress to exert a higher holding force on the trip blade assembly. Further rotation of the unit will move the baseplate upwardly. The spring will continue to compress and the force exerted on the unit will thus also increase. However, the distance between the axis of the hinge 27 and that of the pin 60 decreases from a distance d (FIG. 2) to a final distance f (FIG. 4) at a faster rate than the increase in spring force. The moment o tipping force acting on the unit therefore decreases. The trip blade unit is permitted to rotate upwardly and rearwardly until the leg 31 of the support angle abuts against the lower moldboard support member 13. In practice, the hinge 27 and pivot 60 are arranged so that the holding force exerted on the trip blade unit by the springs is considerably less than that used to hold the unit in the operative position.

As should now be evident, the spring control mechanism operates to initially stiffen the spring force upon the unit striking an object. If the object is not dislodged after the initial impact, the spring forces on the trip blade are uniformly reduced as the blade unit continues back until such time as the unit encounters the lower frame member. The springs never reach full compression and the moldboard assembly will not be lifted by any object that is of a size that is capable of passing through the opened or fully tripped unit. Because of the unique control feature, the present unit is able to pass through obstacles that would ordinarily cause other units to bottom the springs and thus lift the moldboard assembly. Additionally, because the units are relatively short in length, the amount of torque experienced by the assembly is minimized.

While this invention has been described in the specification and illustrated in the drawings with reference to the preferred embodiments, it will be understood by those skilled in the art that various changes may be made and equivalents may be substituted for elements of the invention without departing from the scope of the claims. In addition, many modifications may be made to adapt a particular situation or material to the teachings of the invention without departing from the essential scope thereof. It is intended that the invention not be limited to the particular embodiments illustrated by the drawings and described in the specification as the best mode presently contemplated for carrying out this invention, but that the invention will include any embodiments ralling within the description of the claims.

What is claimed is:

1. Apparatus for operating a trip blade unit in a moldboard assembly that includes hinge means for pivotally mounting at lest one strip blade unit beneath a moldboard so that the unit rotates between an operative plowing position and a fully tripped, open position, biasing means for exerting a force against the trip blade unit through an adjustable moment arm for urging the unit into the operative position under a predetermined holding force, and control means for varying the length of the moment arm so that the force exerted upon the trip blade unit in the fully tripped position is less than the force holding the unit in the operative position.

2. The apparatus of claim 1 wherein said biasing means includes a pair of spring assemblies, each of which contains a compression spring held in a loaded condition between a base plate attached to the adjustable moment arm unit and a rotatable trunnion means so that the length of the moment arm acting on the trip blade unit varies as the spring loading increases.

3. The apparatus of claim 2 wherein each spring assembly further includes a moment arm secured to said trip blade unit an being rotatably connected to said base plate so that the spring assembly swings about the trunnion toward the moldboard as the trip blade unit rotates from an operative position toward a fully tripped position thereby varying the length of the moment arm between the spring assembly and the trip blade unit.

4. The apparatus of claim 3 wherein said biasing means further includes an elongated rod passing through the inside of each compression spring, said rod being secured at one end in said base plate and slidably contained in the trunnion means at the other end.

5. The apparatus of claim 4 wherein said rod has threaded means for said base plate in reference to the trunnion means whereby the loaded condition of the spring can be varied.

6. The apparatus of claim 1 wherein a plurality of trip blade units are hinged in side-by-side alignment beneath the moldboard.

7. Trip blade apparatus for use in a moldboard assembly that includes a moldboard frame that is attachable to a prime mover for supporting a moldboard in a generally vertical position, at least one trip blade unit rotatably mounted in said frame beneath the moldboard so that the unit pivots about a first fixed axis between an operative plowing position wherein the trip blade face is aligned with the moldboard face, and a fully-tripped, open position wherein the trip blade unit is rotated back about the first axis to a generally horizontal, elevated position, pivot means mounted behind the moldboard for rotatably supporting one end of at least one spring biasing means so that the spring biasing means pivots about a second fixed axis, a moment arm rotatably supported in the other end of said spring biasing means and being secured to the trip blade unit so that the spring biasing means exerts a holding moment upon the unit to urge the unit into the operative position, and said first and second fixed axes being arranged so that the length of the moment arm varies such that the force acting on the unit through the moment arm increases initially to a higher level and then decreases to a lower level as the unit rotates from the operative position to the fully tripped position, the force acting on the unit when in the fully tripped position being less than that when the unit is in the operative position.

8. The apparatus of claim 7 that includes a pair of spaced apart spring biasing means that act upon opposite ends of the trip blade unit.

9. The apparatus of claim 8 wherein each spring biasing means includes a trunnion means rotatably mounted in said pivot means at the back of said moldboard, a base plate mounted in said moment arm and a compression spring mounted in a loaded condition between the trunnion means and the base plate.

10. The apparatus of claim 9 that further includes an elongated rod secured to the base plate and slidably contained within the trunnion means, and threaded means on said rod for varying the spring force acting on said trip blade unit.

11. The apparatus of claim 9 that further includes spaced apart bracket means mounted in the back wall of the moldboard having bearing means for rotatably supporting said trunnion means.

12. The apparatus of claim 7 that includes a plurality of trip blade units mounted in side-by-side contiguous relationship along the length of the moldboard.

13. The apparatus of claim 12 wherein the length of each trip blade does not exceed four feet.

14. The apparatus of claim 13 wherein each unit provides at least a six inch high opening when in the fully tripped position.

15. The apparatus of claim 14 that includes a stop means for preventing the trip blade unit from rotating past the fully tripped position.

16. A method of biasing a trip blade unit of a moldboard assembly that includes the steps of pivotally mounting at least one trip blade unit beneath a moldboard so that the unit rotates between an operative plowing position and a fully tripped position, holding the unit in the operative position under an initial predetermined moment, and controlling the moment force acting upon the unit to increase the force from a first initial level to a second higher level and then decrease the force to a third lower level which is less than said first initial level as the trip blade unit moves from said operative position into said fully tripped position.

17. The method of claim 16 including the further step of mounting a plurality of trip blade units in a side-by-side relationship along the length of the moldboard.

18. The method of claim 17 wherein the holding step includes rotatably mounting one top end of a pair of spaced apart compression springs behind the moldboard and pivotally connecting the other bottom end of the springs to the trip blade unit by an adjustable moment arm so that the length of the moment arm varies as the trip blade unit moves between the operative position and the fully tripped position.

19. The method of claim 18 that includes the further step of preloading said springs to exert a predetermined holding force against the unit.

* * * * *